US008998374B2

(12) United States Patent
Hoshino et al.

(10) Patent No.: US 8,998,374 B2
(45) Date of Patent: Apr. 7, 2015

(54) INKJET HEAD AND METHODS OF MANUFACTURING THE INKJET HEAD

(71) Applicant: Toshiba Tec Kabushiki Kaisha, Tokyo (JP)

(72) Inventors: Tomoki Hoshino, Shizuoka (JP); Keizaburo Yamamoto, Shizuoka (JP); Minoru Koyata, Shizuoka (JP); Naoki Ooishi, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/736,798

(22) Filed: Jan. 8, 2013

(65) Prior Publication Data

US 2013/0208055 A1 Aug. 15, 2013

(30) Foreign Application Priority Data

Feb. 14, 2012 (JP) ..... 2012-029156

(51) Int. Cl.
*B41J 2/015* (2006.01)
*B41J 2/14* (2006.01)
*B41J 2/16* (2006.01)

(52) U.S. Cl.
CPC ..... *B41J 2/14201* (2013.01); *B41J 2/1621* (2013.01); *B41J 2/14209* (2013.01); *B41J 2/1609* (2013.01); *B41J 2/1623* (2013.01); *B41J 2/1632* (2013.01); *B41J 2002/14362* (2013.01); *B41J 2002/14491* (2013.01)

(58) Field of Classification Search
None
See application file for complete search history.

(56) References Cited

U.S. PATENT DOCUMENTS

| | | | | |
|---|---|---|---|---|
| 7,066,582 | B2 | 6/2006 | Deguchi et al. | |
| 2002/0044175 | A1 * | 4/2002 | Watanabe | 347/63 |
| 2002/0167568 | A1 * | 11/2002 | Sakuma | 347/68 |
| 2007/0176985 | A1 * | 8/2007 | Takeuchi | 347/85 |

FOREIGN PATENT DOCUMENTS

| | | | |
|---|---|---|---|
| CN | 102189789 | A | 9/2011 |
| JP | 2002-120368 | A | 4/2002 |
| JP | 2009-202473 | | 9/2009 |
| JP | 2009-202473 | A | 9/2009 |

OTHER PUBLICATIONS

Chinese Office Action with English translation, dated Jul. 30, 2014 for Chinese Application No. 201210507529.3, 18 pages.

* cited by examiner

*Primary Examiner* — Matthew Luu
*Assistant Examiner* — Erica Lin
(74) *Attorney, Agent, or Firm* — Patterson & Sheridan, LLP

(57) ABSTRACT

An inkjet head comprises a pressure chamber, piezoelectric elements, and pressure chamber electrodes disposed on an interior side of the pressure chamber, the pressure chamber electrodes being configured to apply a driving voltage to the piezoelectric elements. The inkjet head also includes a nozzle plate adhered to the frame body with the resin film. The nozzle plate includes an ink discharge hole configured to discharge ink. The inkjet head includes a frame body including an attaching part to which a mask that surrounds the outer perimeter of the inkjet head is to be attached. The inkjet head also includes a resin film that coats the pressure chamber electrodes and that includes an end portion that extends to and covers the attaching part. The inkjet head also includes a layer that coats the end portion of the resin film and by which the mask is to be adhered to the frame.

6 Claims, 3 Drawing Sheets

INKJET HEAD AND METHODS OF MANUFACTURING THE INKJET HEAD

CROSS-REFERENCE TO RELATED APPLICATION

This application is based upon and claims the benefit of priority from Japanese Patent Application No. 2012-029156, filed Feb. 14, 2012; the entire contents of which are incorporated herein by reference.

FIELD

Embodiments described herein relate to an inkjet head and methods of manufacturing the inkjet head.

BACKGROUND

An inkjet head is equipped with multiple side walls that are formed by piezoelectric elements with differing polarities that are adhered together one above the other, and electrodes that are installed on these side walls. The side walls change shape elastically due to voltages that are applied to the electrodes. Due to this deformation, the volume of the pressure chamber changes. Due to this change in volume of the pressure chamber, suction and discharge of the ink is performed.

Since there is the possibility that water-soluble ink would be used, there is the necessity to insulate the electrodes. Traditionally, electrodes are coated with, for example, resins typified by paraxylene polymers such as Parylene®. However, the ink can intrude from the edge parts of this resin film and corrode the electrodes.

Regarding this point, technology to place grease on the edge parts of the resin film has been proposed.

However, even with this technology, grease can dissolve in ink if the ink comes in contact with the grease, and there remains the possibility that the ink will come in contact with the electrodes.

DETAILED DESCRIPTION

An inkjet head according to an embodiment of the present disclosure comprises a substrate, side walls that are formed pectinately, a pressure chamber defined by the side walls, and piezoelectric elements. The inkjet head also includes pressure chamber electrodes that are disposed on an interior side of the pressure chamber and substrate electrodes that are disposed on the substrate and connected to the pressure chamber electrodes. The inkjet head also includes a frame body with an attaching part to which a mask that surrounds the outer perimeter of the inkjet head is to be attached. The inkjet head also includes a resin film that coats the pressure chamber electrodes and the substrate electrodes. The resin film includes an end portion that extends to and covers the attaching part. The inkjet head also includes a nozzle plate adhered to the frame body with the resin film. The nozzle plate includes an ink discharge hole configured to discharge ink. The nozzle plate also includes a layer that coats the end portion of the resin film and by which the mask is to be adhered to the frame.

A manufacturing method for an inkjet head is provided in an embodiment of the present disclosure. The manufacturing method comprises providing a substrate, providing a frame body having an attaching part to which a mask that surrounds the outer perimeter of the frame is to be attached, and forming substrate electrodes on the substrate. The manufacturing method also includes forming a resin film on the substrate electrodes so that end parts of the resin film extend to the attaching part of the frame body, and so that the resin film coats the substrate electrodes. The manufacturing method also includes forming a layer which coats the edge parts of the resin film and by which the mask is to be adhered to the frame.

An inkjet head according to an embodiment comprises a pressure chamber, piezoelectric elements, and pressure chamber electrodes disposed on an interior side of the pressure chamber, the pressure chamber electrodes being configured to apply a driving voltage to the piezoelectric elements. The inkjet head also includes a nozzle plate adhered to the frame body with the resin film. The nozzle plate includes an ink discharge hole configured to discharge ink. The inkjet head includes a frame body including an attaching part to which a mask that surrounds the outer perimeter of the inkjet head is attached. The inkjet head also includes a resin film that coats the pressure chamber electrodes and that includes an end portion that extends to and covers the attaching part. The inkjet head also includes a layer that coats the end portion of the resin film and by which the mask is to be adhered to the frame.

Figure 1:
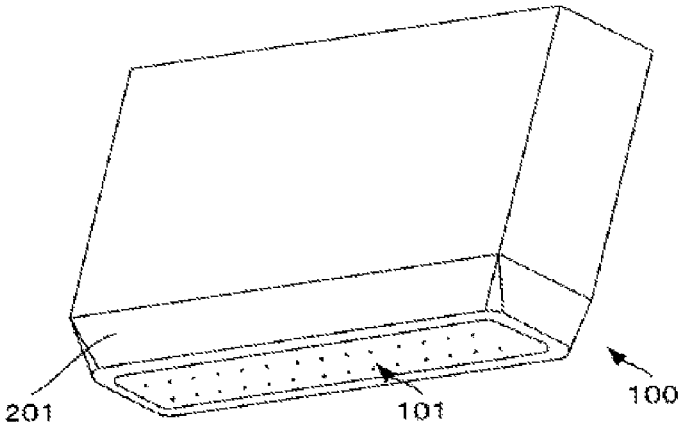
FIG. 1 is a perspective view of the inkjet head main unit that includes the inkjet head, according to an embodiment.

FIG. 1 is a perspective view of an inkjet head main unit 100 that includes an inkjet head 101. As shown in FIG. 1, the inkjet head main unit 100 is equipped with the inkjet head 101. The inkjet head 101 is placed at one end of the inkjet head main unit 100. A mask 201 supports the inkjet head 101.

Figure 2:
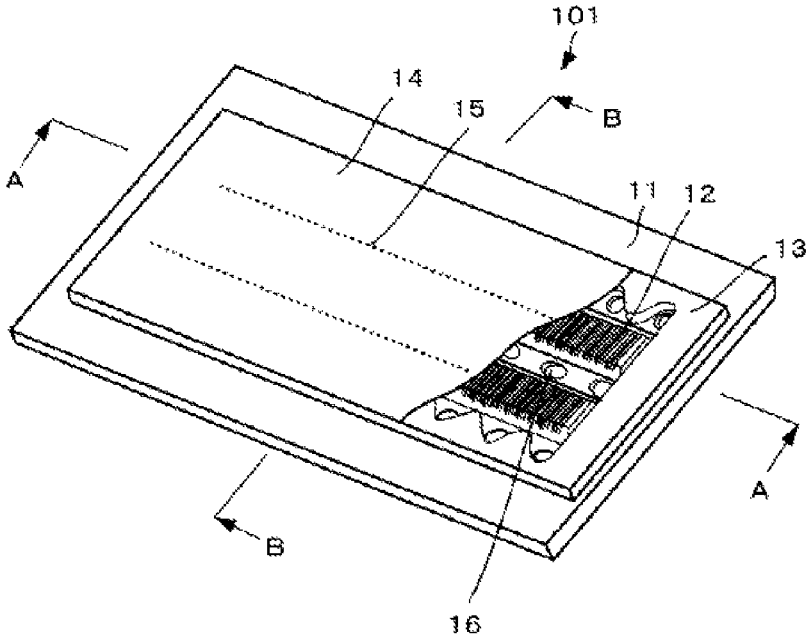
FIG. 2 is a perspective view of the inkjet head, according to the embodiment.

FIG. 2 is a perspective view of the inkjet head 101. As shown in FIG. 2, the inkjet head 101 includes a substrate 11 that is formed by alumina, etc., piezoelectric elements 12 that are placed on the substrate 11, and a frame body 13 that is placed so that it surrounds the piezoelectric elements 12. An ink discharge hole 15 is formed in a nozzle plate 14. The nozzle plate 14 covers the piezoelectric elements 12 and the frame body 13.

The inkjet head 101 includes a common liquid chamber 16 in the space surrounded by the substrate 11, the piezoelectric elements 12, the frame body 13, and the nozzle plate 14.

Figure 3:
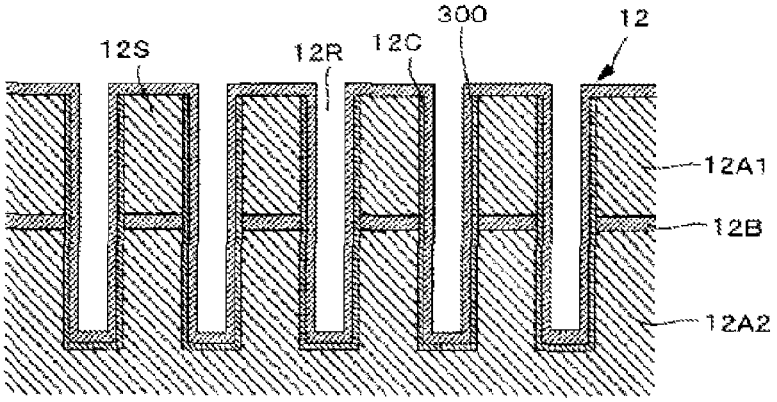
FIG. 3 is a cross-sectional view of the inkjet head, taken across the A-A line in FIG. 2.

FIG. 3 is a cross-section view of the inkjet head 101, taken across the A-A line in FIG. 2. As shown in FIG. 3, the piezoelectric element 12 is comprised of piezoelectric elements 12A1 and 12A2, which have differing polarities. The piezoelectric elements 12A1 and 12A1 are adhered together with the adhesive agent 12B. The inkjet head 101 is equipped with multiple side walls 12S that are formed pectinately. The gaps between the side walls 12S form the pressure chamber 12R.

Pressure chamber electrodes 12C are placed on the bottom surfaces of the side walls 12S and the pressure chamber 12R. Furthermore, a resin film 300 coats the pressure chamber electrodes 12C.

The pressure chamber 12R communicates with the common liquid chamber 16. The pressure chamber electrodes 12C connect to a drive element (i.e., drive circuit connection unit 305 in FIG. 5, discussed further below) that applies voltage to the piezoelectric elements 12. The ink discharge hole 15 of the nozzle plate 14 is installed in a location that corresponds to the pressure chamber 12R.

Regarding the piezoelectric elements 12, for example, PZT (lead zirconium titanate) can be used. For the resin film, paraxylene polymers such as Parylene® can be used. Moreover, any grade of Parylene® can be used.

When voltage is applied, the side walls 12S change shape, and due to this shape change, the volume of the pressure chamber 12R changes. Due to this volume change, ink suction and discharge from the ink discharge hole 15 is performed.

Figure 4:
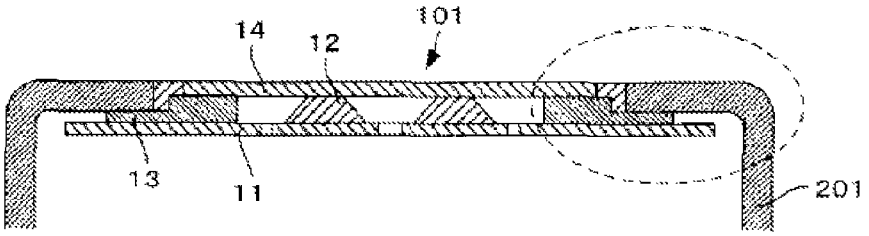
FIG. 4 is a cross-sectional view of the inkjet head, taken across the B-B line in FIG. 2.

FIG. 4 is a cross-section view of the inkjet head 101, taken across the B-B line in FIG. 2. As shown in FIG. 4, the inkjet head 101 is arranged with the nozzle plate 14 to recording medium side. The inkjet head 101 is attached to the mask 201.

Figure 5:
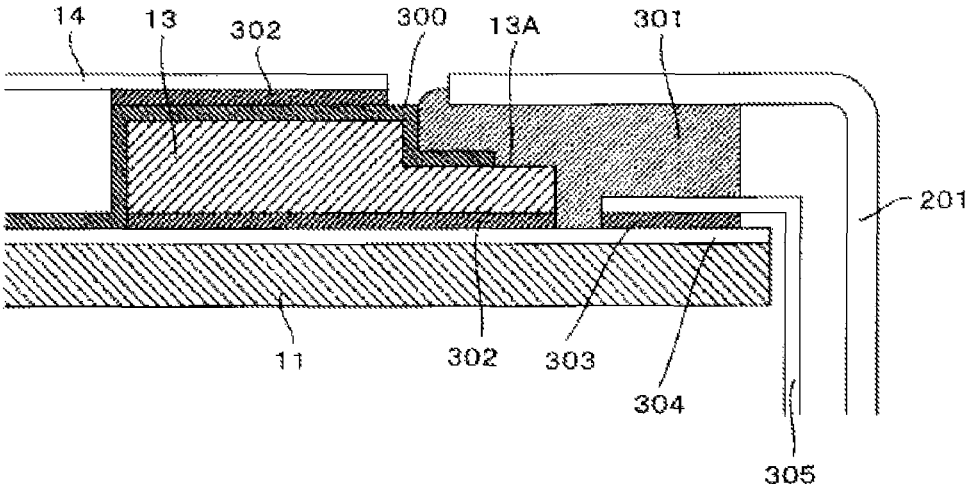
FIG. 5 is an enlarged view illustrating the portion encircled by the dotted lines in FIG. 4.

FIG. 5 is a enlarged view illustrating the portion encircled by the dotted lines in FIG. 4. As shown in FIG. 5, the inkjet head 101 includes the substrate 11, substrate electrodes 304 disposed on the substrate 11, and a frame body 13 that is disposed on the substrate electrodes 304. The frame body 13 includes an attaching part 13A for attaching the mask 201. A resin film 300 includes an edge portion that extends to the attaching part 13A. The nozzle plate 14 is attached to the frame body 13 via the resin film 300. A drive circuit connection unit 305 connects to the substrate electrodes 304 via an anisotropically conductive film (ACF) 303. An adhesive layer 301 coats the edge portion of the resin film 300. The adhesive layer 301 also adheres the inkjet head 101 to the mask 201.

It is preferable that the attaching part 13A is one step lower than an upper edge of the frame body 13, but it can be of any form.

The resin film 300 coats the pressure chamber electrodes 12C and the substrate electrodes 304. Furthermore, the resin film 300 coats a part that extends from the substrate 11 to the attaching part 13A of the frame body 13. That is, the edge part of the resin film 300 extends from the interior side of the frame body 13 to the inner edge part of the attaching part 13A.

An adhesive agent with anti-ink properties is used for the adhesive layer 301 For example, epoxy resin adhesive agents can be used for adhesive layer 301. According to the present embodiment, the adhesive agent with anti-ink properties is applied by a dispenser to form the adhesive layer 301.

The substrate electrodes 304 and the frame body 13, as well as the frame body 13 and the nozzle plate 14, are adhered together, respectively, with an adhesive agent 302. The substrate electrodes 304 connect with the pressure chamber electrodes 12C.

The inkjet head 101 of this embodiment has all of the edge parts of its resin film 300 coated with the adhesive layer 301. Therefore, ink will not come in contact with the edge part of the resin film 300.

Next, the manufacturing method for the inkjet head 101 of this embodiment will be explained.

(1) A pair of piezoelectric elements 12 is adhered to the substrate 11. The distance of one pair of the piezoelectric elements 12 is positioned by a jig.

(2) A channel (defined by sidewalls 12S) that becomes the pressure chamber 12R is formed by machining the piezoelectric elements 12. This machining can be done by using a diamond wheel.

(3) Pressure chamber electrodes 12C are formed inside the channel. The pressure chamber electrodes 12C can be formed, for example, by forming a nickel membrane with a non-electrolytic plating.

(4) The frame body 13 is adhered to the substrate 11.

(5) The resin film 300 is formed over the pressure chamber electrodes 12C in the piezoelectric elements 12. The resin film 300 is film-formed with CVD (Chemical Vapor Deposition).

The resin film 300 is film-formed so that it reaches the attaching part 13A of the frame body 13.

In the case of using Parylene® for the resin, it is film-formed by using Parylene C at 1 μm to 10 μm. Any grade of Parylene® can be used.

In areas where there is not a need to generate a resin film 300, they can be masked using masking tape such as polyimide tape. Alternatively, after film-forming the resin film 300, the necessary areas can be coated with a jig, and the unnecessary resin film 300 can be removed by edging using plasma treatment.

(6) The nozzle plate 14 with the ink discharge hole 15 that is formed in advance using laser illumination, etc., is adhered to the frame body 13.

(7) The substrate electrodes 304 and the drive circuit connection unit 305 are thermal compression adhered with an anisotropically conductive film 303.

(8) The mask 201 is adhered to the frame body 13 using the adhesive layer 301, (formed with the adhesive agent with anti-ink properties).

The adhesive layer 301 coats the edge parts of the resin film 300. The adhesive layer 301 can be formed so that it coats a portion of the drive circuit connection unit 305 and a portion of the substrate electrodes 304 that are in between the drive circuit connection unit 305 and the frame body 13.

(9) The ink feed pipe and the ink discharge tube are adhered to the substrate 11.

As mentioned above, the inkjet head 101 of this embodiment is equipped with a substrate 11, side walls 12S that are formed pectinately, and a pressure chamber 12R that is defined by the side walls 12S. The inkjet head 101 is also equipped with piezoelectric elements 12 that include pressure chamber electrodes 12C, which are electrodes that are installed on the inside of the pressure chamber 12R. The inkjet head 101 is also equipped with substrate electrodes 304 that connect to the pressure chamber electrodes 12C, which are electrodes that are placed on the substrate 11. Lastly, the inkjet head 101 is equipped with a frame body 13 that is installed on the substrate electrodes 304 and includes an attaching part 13A where a mask 201 is attached, a resin film 300 which extends to the attaching part 13A, a nozzle plate 14 that is attached to the frame body 13 via the resin film 300, and an adhesive layer 301 that covers the end parts of the resin film 300 and is adhered to the mask 201.

Therefore, there is the beneficial effect that the ink will not come in contact with the electrodes by running along the resin film.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a pressure chamber;

piezoelectric elements;

pressure chamber electrodes disposed on an interior side of the pressure chamber, the pressure chamber electrodes configured to apply a driving voltage to the piezoelectric elements;

a frame body including an attaching part to which a mask that surrounds the outer perimeter of the inkjet head is to be attached;

a nozzle plate adhered to the frame body with a resin film, the nozzle plate including an ink discharge hole configured to discharge ink;

the resin film coating the pressure chamber electrodes and including an end portion that extends to and covers the attaching part; and a layer that coats the end portion of the resin film and by which the mask is to be adhered to the frame.

2. The inkjet head according to claim 1, wherein the end portion of the resin film extends from an interior side of the frame body to an inner edge of the attaching part.

3. The inkjet head according to claim 1, further comprising:

substrate electrodes connected to the pressure chamber electrodes; and a drive circuit connection unit that connects to the substrate electrodes, the drive circuit configured to supply the driving voltage to the pressure chamber electrodes, wherein the layer coats a portion of the drive circuit connection unit and a portion of the substrate electrodes that is between the drive circuit connection unit and the frame body.

4. The inkjet head according to claim 3, wherein the drive circuit connection unit is connected to the substrate electrodes via an anisotropically conductive film.

5. The inkjet head according to claim 3, wherein the frame body is disposed on the substrate electrodes.

6. The inkjet head according to claim 1, wherein the attaching part of the frame body is lower than an upper edge of the frame body.

* * * * *